US005611181A

United States Patent [19]

Shreiner et al.

[11] Patent Number: 5,611,181

[45] Date of Patent: Mar. 18, 1997

[54] SEISMIC EXPANSION JOINT COVER

[75] Inventors: Thomas A. Shreiner, Picture Rocks; Roger W. Barr, Williamsport, both of Pa.

[73] Assignee: Construction Specialties, Inc., Cranford, N.J.

[21] Appl. No.: 340,036

[22] Filed: Nov. 14, 1994

[51] Int. Cl.[6] ..... E04B 1/68

[52] U.S. Cl. ..... 52/396.04; 52/167.1; 52/396.08; 52/396.09; 52/573.1; 52/DIG. 13; 404/47; 404/67; 404/68

[58] Field of Search ..... 52/573.1, DIG. 13, 52/396.01, 396.04, 20, 167.1, 396.08, 396.09; 404/68, 47, 67; 14/73.1

[56] References Cited

U.S. PATENT DOCUMENTS

| | | | |
|---|---|---|---|
| 3,371,456 | 3/1968 | Balzer et al. | 52/395 X |
| 3,992,121 | 11/1976 | Geiger | 52/DIG. 13 X |
| 4,893,448 | 1/1990 | McCormick | 404/68 X |

FOREIGN PATENT DOCUMENTS

| | | | |
|---|---|---|---|
| 614711 | 12/1948 | United Kingdom | 52/562 |

*Primary Examiner*—Christopher T. Kent
*Attorney, Agent, or Firm*—Brumbaugh, Graves, Donohue & Raymond

[57] ABSTRACT

A seismic expansion joint cover for concealing an expansion gap between building members comprises retainers attached to building members on each side of the expansion gap and a cover spanning the expansion gap and overlying at least portions of the first and second retainers and a portion of the building member on at least one side of the gap. The cover is attached to the retainers by releasable fasteners, such as hook and loop fasteners, that enable it to detach completely from the retainers in an earthquake and to be subsequently reattached. One element of each of the fasteners on one side of the gap is attached to a slider that slides along a track affixed to the internal side of the cover to enable normal thermal expansions and contractions of the gap. Tethers keep the cover from falling to the floor and becoming an obstacle to persons moving through the building.

45 Claims, 6 Drawing Sheets

SEISMIC EXPANSION JOINT COVER

BACKGROUND OF THE INVENTION

Seismic expansion joint covers for buildings in geographic regions that are prone to earthquakes are commonly of special designs that allow for movements of the building elements on either side of the expansion gap that are very much greater than the movements that occur as a result of thermal expansion and contraction. Most seismic expansion joint covers follow traditional design philosophies that have long been applied to expansion joint covers that are not intended to sustain earthquakes; they use metal covers and various fastening systems to join the covers to frame members that are attached to the building members on either side of the expansion gap in such a way as to retain the covers in place in the gap during seismic events while permitting the large motions of the members.

In a commonly used fastening system, the cover is attached by bolts to the centers of spaced-apart bridge bars that span the gap with their ends sliding in trackways in the frame members. As the gap expands and contracts, the bridge bars pivot about the connecting bolts. An example of a seismic expansion joint cover system that uses bridge bars is found in Moulton U.S. Pat. No. 5,078,529 issued Jan. 7, 1992, for "Seismic Expansion Joint Cover."

Previously known seismic expansion joint covers can sustain relatively weak earthquakes but are severely damaged, often beyond repair, in severe earthquakes, such as the one that occurred in Jan. 1994, just north of Los Angeles. An inspection of several installations of seismic expansion joint covers of various designs in the Los Angeles area just after that earthquake revealed bent and mangled covers, failed connectors, frames ripped from their anchors in the walls and floors, and damage to the walls adjacent the covers caused by impacts of the partially detached covers against the walls. Few of the inspected installations were repairable.

SUMMARY OF THE INVENTION

One object of the present invention is to provide a seismic expansion joint cover for walls and ceilings that is able to sustain a severe earthquake with little likelihood of damage to the cover or the wall or ceiling in which it is installed. Another object is to provide an expansion joint cover in which the cover can be quickly and easily reinstalled after it becomes detached in a seismic event. Still another object is to provide an expansion joint cover that is inexpensive and attractive in appearance. It is also desired that an expansion joint cover, according to the present invention, be fire retardant, have a low mass, and minimize noise transmission.

The foregoing objects are attained, in accordance with the present invention, by a seismic expansion joint cover that includes a first retainer attached to a building member on one side of the expansion gap, a second retainer attached to a building member on the other side of the expansion gap, and an elongated cover having an internal face, an external face and side edges and having a width such that it spans the expansion gap and overlies a portion of a building member (a wall or ceiling) on at least one side of the gap. At least two first releasable fasteners join the cover to the first retainer, the first fasteners being spaced apart lengthwise of the cover. At least two slide tracks are attached to the internal face of the cover in spaced-apart relation lengthwise of the cover, each slide track being perpendicular to the longitudinal axis, being positioned to overlie the second retainer, and receiving a movable slider for movement along the track. A second releasable fastener joins each slider to the second retainer.

The first and second fasteners are of a type that is readily detached in a seismic event and that can be refastened after it has been detached. In particular, the fasteners may be hook and loop fasteners, magnets, and gravity clips (sometimes called Z-clips), hook and loop fasteners being particularly preferred. At least one tether, such as a flexible cable or cord, connects the cover to the wall or ceiling adjacent the expansion gap so as to retain the cover proximate to the wall or ceiling in the event of release of the fasteners. Accordingly, the cover is kept from falling to the floor and becoming an obstacle to movement of persons and things. On the other hand the tether allows the cover to fall away from the expansion gap, thereby minimizing the possibility that it will be caught in the gap and damaged or cause damage to the retainers or the wall or ceiling.

In some embodiments, each slide track is recessed into the internal face of the cover, at least one edge of the cover slidably engages a surface of a building member on one side of the expansion gap, and the second retainer has a surface substantially flush with the surface of the building member. Where the gap occurs at a corner, only one surface of the building member is engaged. Otherwise, the cover engages surfaces on both sides of the gap. In some installations, the surfaces on either side of the gap are planar surfaces of a continuous wall or ceiling. In other installations, the surface of the building member engaged by one or both edges of the cover is a surface of a recessed portion of the wall or ceiling, in which case the external surface of the cover may be flush with the portions of the wall or ceiling adjacent the recesses.

Each slide track may extend across the cover such that a portion overlies the first retainer, and a non-movable slide member is received in each slide track in said portion and is fixed therein against movement. In that case, each first releasable fastener is connected between a non-movable slider and the first retainer. Slide tracks that span the cover widthwise provide lateral stiffness to the cover, provide enhanced retention of the releasable fasteners, and facilitate maintaining desired locations of the releasable fasteners during manufacture, particularly in the thickness direction because of the recessing of the slide tracks.

In embodiments that are surface-mounted, the cover will ordinarily have a substantially uniform profile in transverse cross-section along its length and will, preferably, be substantially thicker at the longitudinal center than adjacent the edges. The thinner edges present the appearance of a thin profile in a surface-mounted installation. The external face of the cover may be convexly curved laterally and the internal face substantially planar.

The cover may be made by compression-molding of a composite material that includes a fiber filler, such as glass fibers, and a suitable binder. The external face of the cover may have a covering of a sheet material, such as a heavy paper, that is adapted to receive paint or wallpaper. Alternatively, the cover also can be built up from a skeletal frame that includes slide tracks and roll-formed or brake formed metal skins, metal sheet stock, or panels of a polymeric material, which can be thermo-formed.

It is advantageous, though not necessary, to provide at least one deflector member extending from the internal surface of the cover and positioned and formed so as to engage a retainer and effect detachment of the fasteners.

When the cover is recessed into a wall or ceiling, the recesses on either side may be left uncovered to provide reveal surfaces or a flexible gasket may be connected between each edge of the cover and an edge of a surface adjacent the recessed portion of the building member. The gaskets may be of the type described and shown in the Shreiner U.S. Pat. No. 5,048,249, issued Sep. 17, 1991, for "Gasket For Flush Expansion Joint Cover," which is incorporated herein by reference. Those gaskets are designed to detach relatively easily from receiving grooves along the edges of the cover and receiving grooves in wall-side gasket retainers. Recessed covers are, preferably, of substantially uniform thickness throughout and have external surfaces that are substantially flush with the wall or ceiling surfaces adjacent the recessed portion.

An important and highly advantageous characteristic of a seismic expansion joint, according to the present invention, is that the covers are permitted by the fasteners to become completely detached from the building members, except for being loosely tethered to keep them from getting in the way after they have become detached. The complete detachment is a departure in principle from previously known seismic expansion joint covers, such as those in which the covers are resiliently retained in a manner that allows them to move out of the gap when the gap closes but are also pulled back into the gap when the gap opens or covers that are designed to permit large movements but remain in place. The previously known covers have proven to be largely incapable of surviving a major earthquake without damage, often irreparable damage.

Another advantage of the expansion joint covers of the present invention is the ease with which they can be restored to their installed state after detachment. All that is required is to place them in proper position and when hook and loop fasteners are used, push them firmly toward the wall or ceiling at the locations of the fasteners. The preferred hook and loop fasteners, as described below, emit an easily detected "snap" or "pop" when the are connected. If a cover is damaged, it is removed by simply disconnecting the tether. Previously known seismic expansion joint covers require removal of screws or bolts, such as screws by which the covers are fastened at intervals to bridge bars.

Covers made of composite materials or built up from cores and skins are light in weight and yet strong and stiff. They are easy to transport and handle, and are of low mass, which reduces the possibility of harming wall and ceiling surfaces when they are detached and everything is shaking to and fro and of becoming a hazard to pedestrians. They are also fire retardant. Covers of composite materials have good acoustical properties, which is important in preventing transmission of noise, such as "street noise," through the expansion joint. Heavy paper coverings permit painting and wallpapering to match the walls, both upon initial installation and upon redecorating.

For a better understanding of the inventions reference may be made to the following description of exemplary embodiments, taken in conjunction with the accompanying drawings.

DESCRIPTION OF THE EMBODIMENTS

Figure 1:
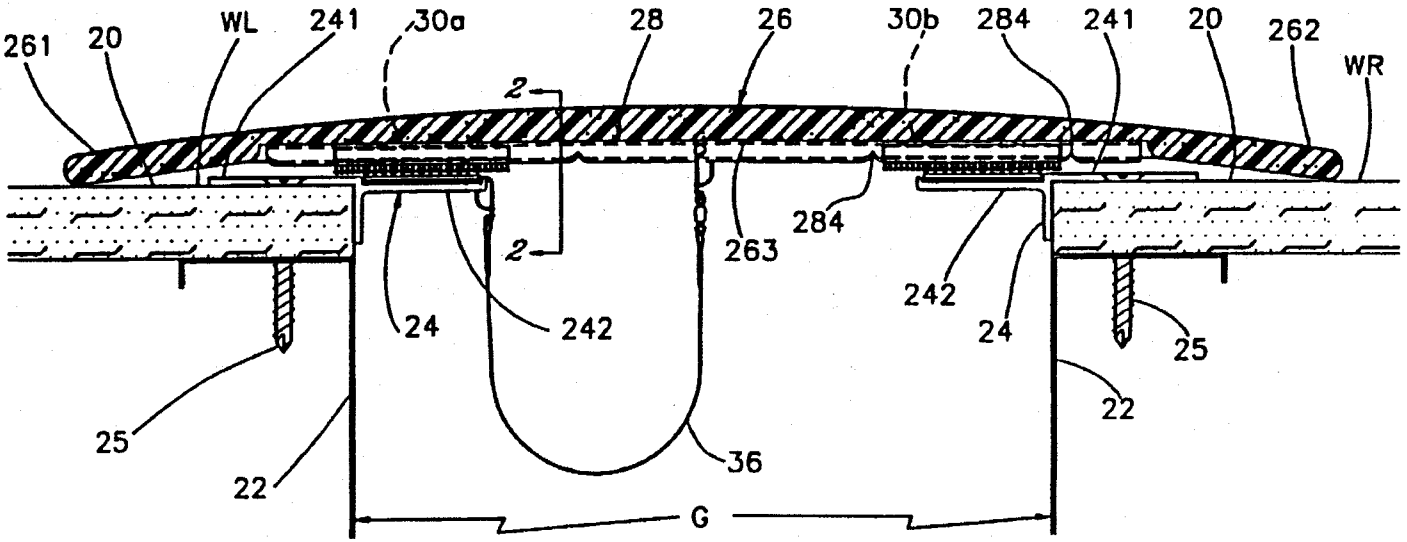
FIG. 1 is an end cross-sectional view of a first embodiment, showing the expansion gap at a neutral width.
Figure 2:
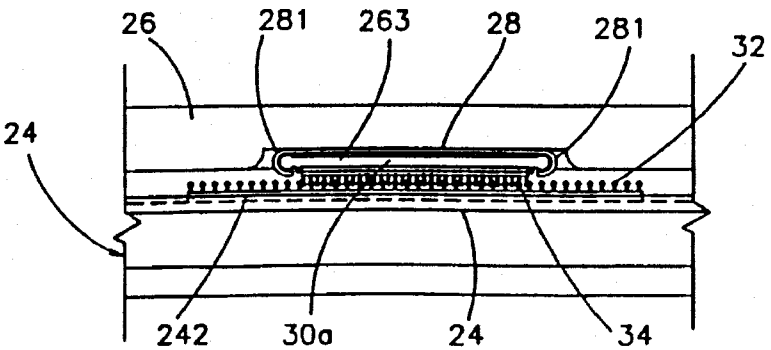
FIG. 2 is a detail side cross-sectional view taken along the lines 2—2 of FIG. 1.

The embodiment of FIGS. 1 to 5 is designed for mounting on the surfaces of two portions WL and WR of a wall or ceiling. For convenience, a building wall or ceiling is referred to hereinafter as a "wall," with the understanding that the expansion joint covers of the present invention are equally useful for ceilings. The wall surfaces are, for example, the faces of gypsum wallboard panels 20, which are fastened to sheet metal studs 22. The expansion joint cover bridges and conceals an expansion gap G between the wall portions WL and WR.

An elongated retainer 24 is fastened to each wall portion WL and WR on either side of an expansion gap by sheet metal screws 25 that pass through a leg portion 241 that overlies the edge of the wallboard panel. A leg portion 242 of each retainer 24 projects out into the expansion gap. Although it is preferred to use retainers that extend continuously along substantially the entire length of the expansion gap, it is possible to use retainer brackets located at suitable intervals along the gap.

A cover 26 spans the gap widthwise and extends along the entire length of the gap. Portions along each side edge 261 and 262 of the cover overlie portions of the wall surfaces adjacent the gap G. The cover 26 is compression molded from a composite material, which contains fibers, such as glass fibers, bonded by a suitable binder, such as a formaldehyde. The cover is of uniform profile in transverse cross-section along its length, is thicker at its center than along the edges 261, 262, and is slightly cupped transversely so as to present a slightly convexly curved external surface. The relatively thin edges and the smooth curvature present a "thinline" appearance to an observer. A heavy paper of the type used on gypsum wallboard covers the exposed surfaces of the cover so that the surfaces can be painted or wallpapered to match or coordinate with the wall surfaces.

Recesses 263 are molded into the internal or back surface of the cover 26 at suitable intervals along its length. Each recess receives a slide track 28, which is generally channel-shaped and include a flange portion 281 along each side (FIG. 2) that forms an undercut edge groove. The slide tracks 28 may be pieces cut from an extrusion of metal or plastic or from a brake-formed or roll-formed metal band and are suitably fastened to the cover 26, such as by adhesive bonding. Each slide track is somewhat longer that the width of the expansion gap and receives a pair of sliders **30*a* and 30*b*, which are, preferably, pieces cut from an extrusion of a polymeric material, such as polyvinyl chloride, and are shaped and dimensioned in cross section so as to be retained in the slide track and to slide along the slide track. One of the sliders 30***b* is, however, secured in the slide track against movement by crimps 284 in the flange portions 281 of the slide track.

A piece 32 of one element of a hook and loop fastener is fastened, such as by adhesive bonding, to the leg portion 242 of each retainer at each location along the length of the retainer that is crossed by a slide track 28 of the cover. The leg portion 242 has a shallow recess into which the base sheet portion of the fastener element fits, thereby providing a mechanical attachment against shifting or peeling in the plane of the walls. A piece 34 of the other element of the hook and loop fastener is attached, such as by adhesive or thermal bonding to each slider 30*a*, 30*b*. A suitable hook and loop fastener is available from 3M Industrial Tape and Specialties Division of St. Paul, Minn. as Type 400 "Dual Lock" reclosable fastener. Both elements of that fastener have mushroom-like stems that interengage to provide a highly tenacious releasable connection. The stems are also durable and can be released and refastened numerous times with no significant loss of tenacity. While less preferred, magnets and gravity clips can be substituted for hook and loop fasteners.

Each retainer 24 has a hole for one end of a tether 36, such as a steel cable or elastic shock cord. Elastic shock cord has the advantage of absorbing energy and reducing the forces acting on the connection points between the tether and the cover and retainer, at approximately the location of each piece 32 of hook and loop fastener. Each slide track 28 has a hole for the other end of the tether. Each tether has snap hooks 361 at each end that allow it to be connected to a hole in a slide track and a hole in the retainer. Generally, it is desirable to use two tethers for the cover, one near each end. In a wall installation, a single tether near the top may suffice.

The cover 26 is installed on a wall or ceiling, to which the retainers 24 with the fastener elements 32 in place have been previously attached on either side of the expansion gap G, by first attaching the tethers 36 between the retainer and tracks and then simply lining up the edge of the cover closest to the non-movable sliders 30*b* at the proper distance from the gap G, which may be temporarily marked with light pencil marks or pieces of masking tape. Each movable slider 30*a* is moved along the slide track to a position such that it will register widthwise with the fastener element to which it will be affixed, which will vary depending on the width of the expansion gap at the time of installation and can be measured. After the adjustment of the movable sliders 30*a* and positioning of the cover relative to the gap, the cover is pushed firmly toward the wall at locations near each fastener. The fasteners emit a snap or pop noise as the mushroom stems interengage, which signals proper connection. In the installed condition, the edges of the 261 and 262 of the cover slidably engage, or just clear, the exposed wall surfaces.

Figure 3:
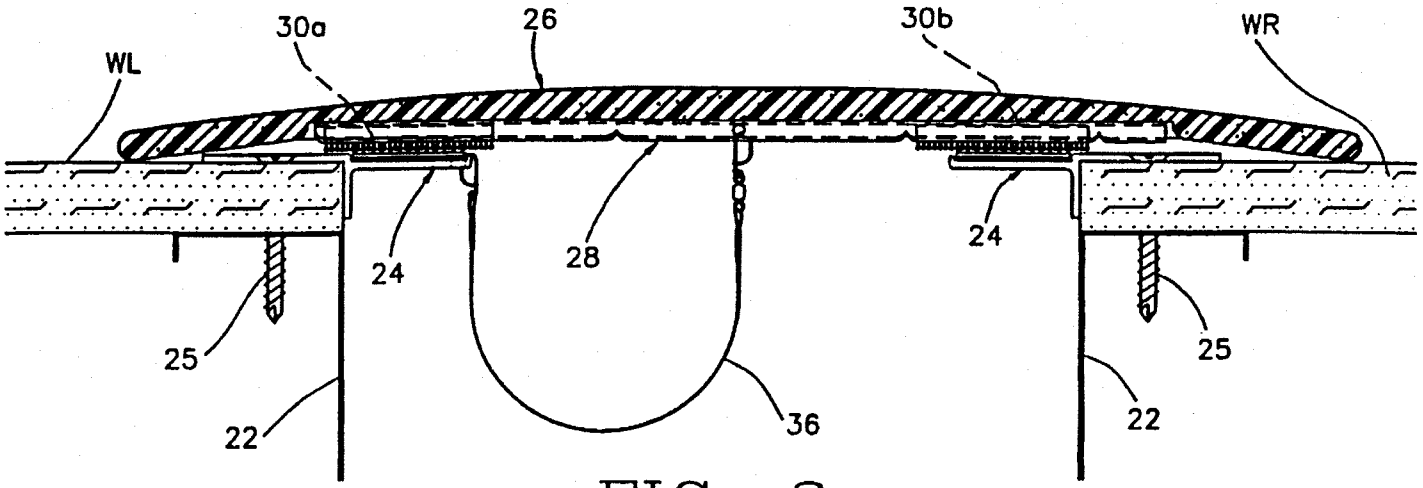
FIG. 3 is an end cross-sectional view of the first embodiment, showing the expansion gap at its greatest normal width.
Figure 4:
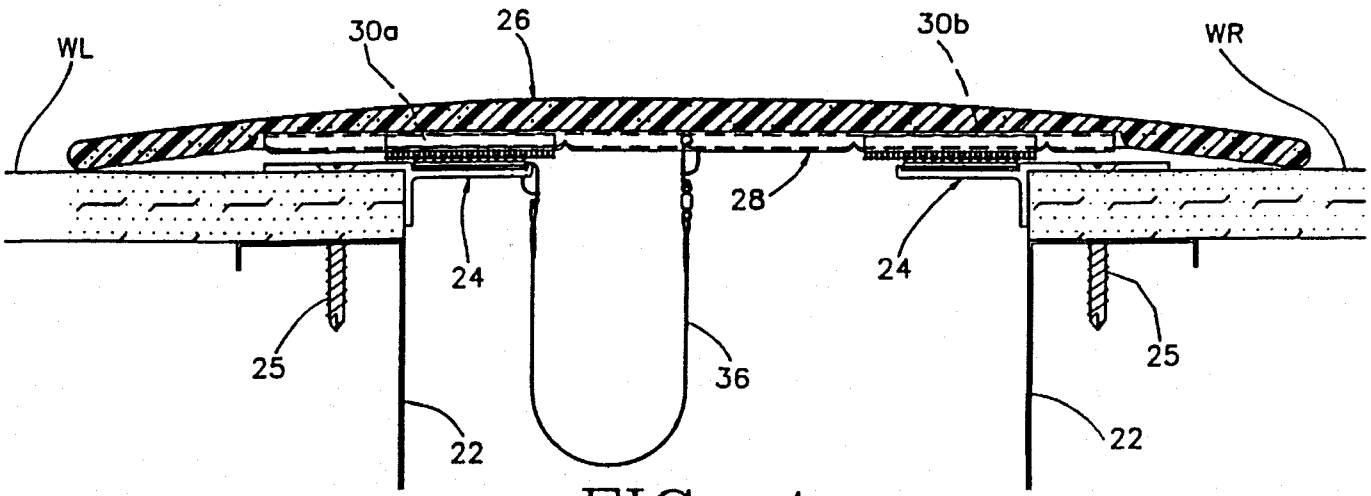
FIG. 4 is an end cross-sectional view of the first embodiment, showing the expansion gap at its smallest normal width.

Normal expansions and contractions of the gap with thermal changes are accommodated by the seismic expansion joint by movements of the movable sliders along the slide tracks, as shown in FIGS. 3 and 4. The non-movable slider 30*b* maintains the cover in register with the gap widthwise so that it cannot drift to one side or the other as the gap expands and contracts over successive cycles —one edge of the cover remains stationary widthwise.

Figure 5:
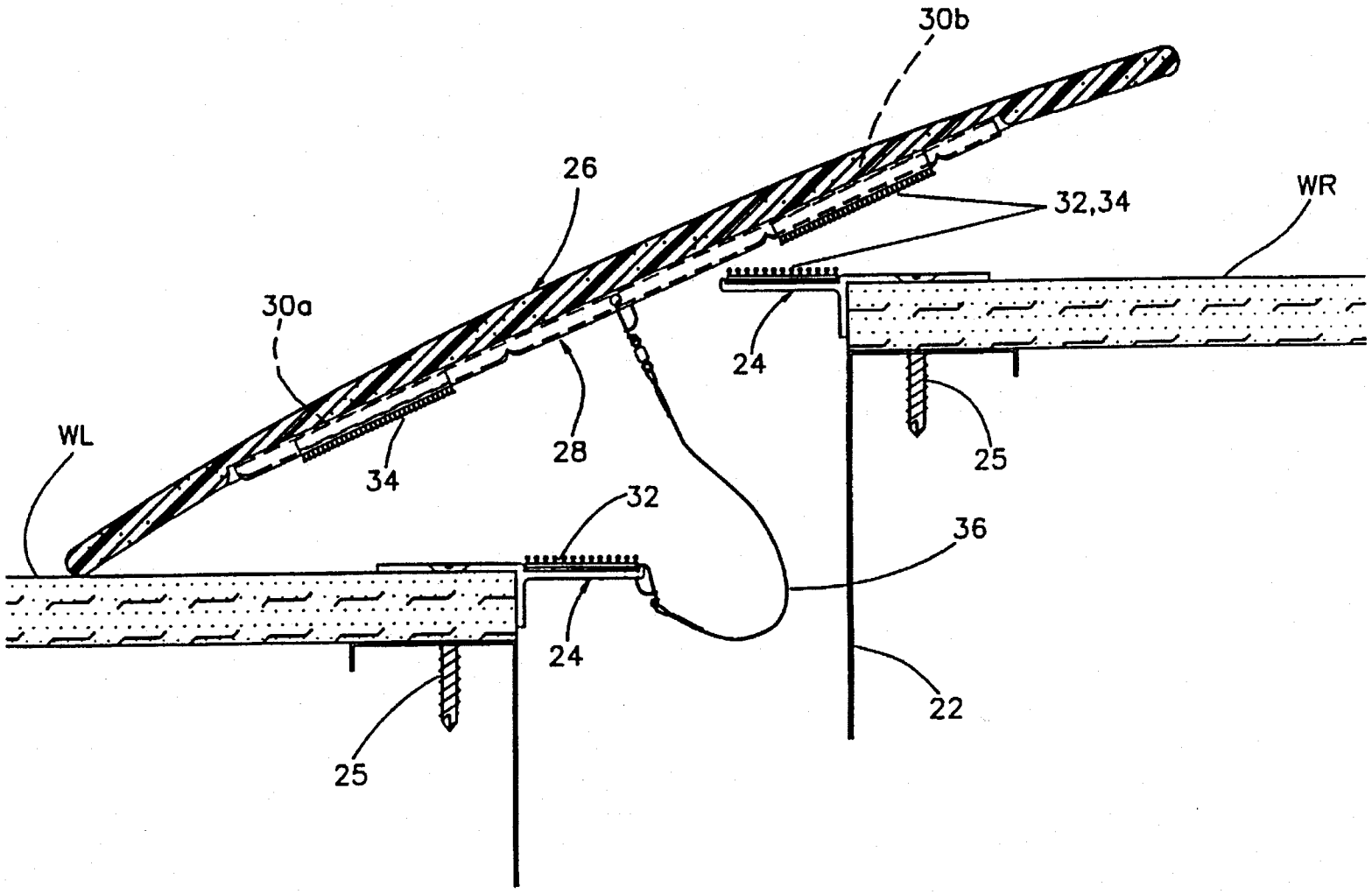
FIG. 5 is an end cross-sectional view of the first embodiment, showing the cover detached from the retainers, such as occurs during an earthquake.

In an earthquake, the fasteners release the cover so that it can fall away from the wall and ceiling, as shown in FIG. 5. To ensure disengagement of the cover when the portions of the building on either side of the gap move predominantly in the plane of wall surfaces, a deflector of the form shown in FIG. 7 and described below can be attached to each track. The tethers 36 keep the cover from falling to the floor and becoming an impediment to persons or objects moving in the area of the gap. After the earthquake, the cover can usually (absent damage) be reinstalled in the same manner as it was first installed. If a cover is damaged, it can be removed by unhooking it from the tethers 36 and a new cover installed.

Figure 6:
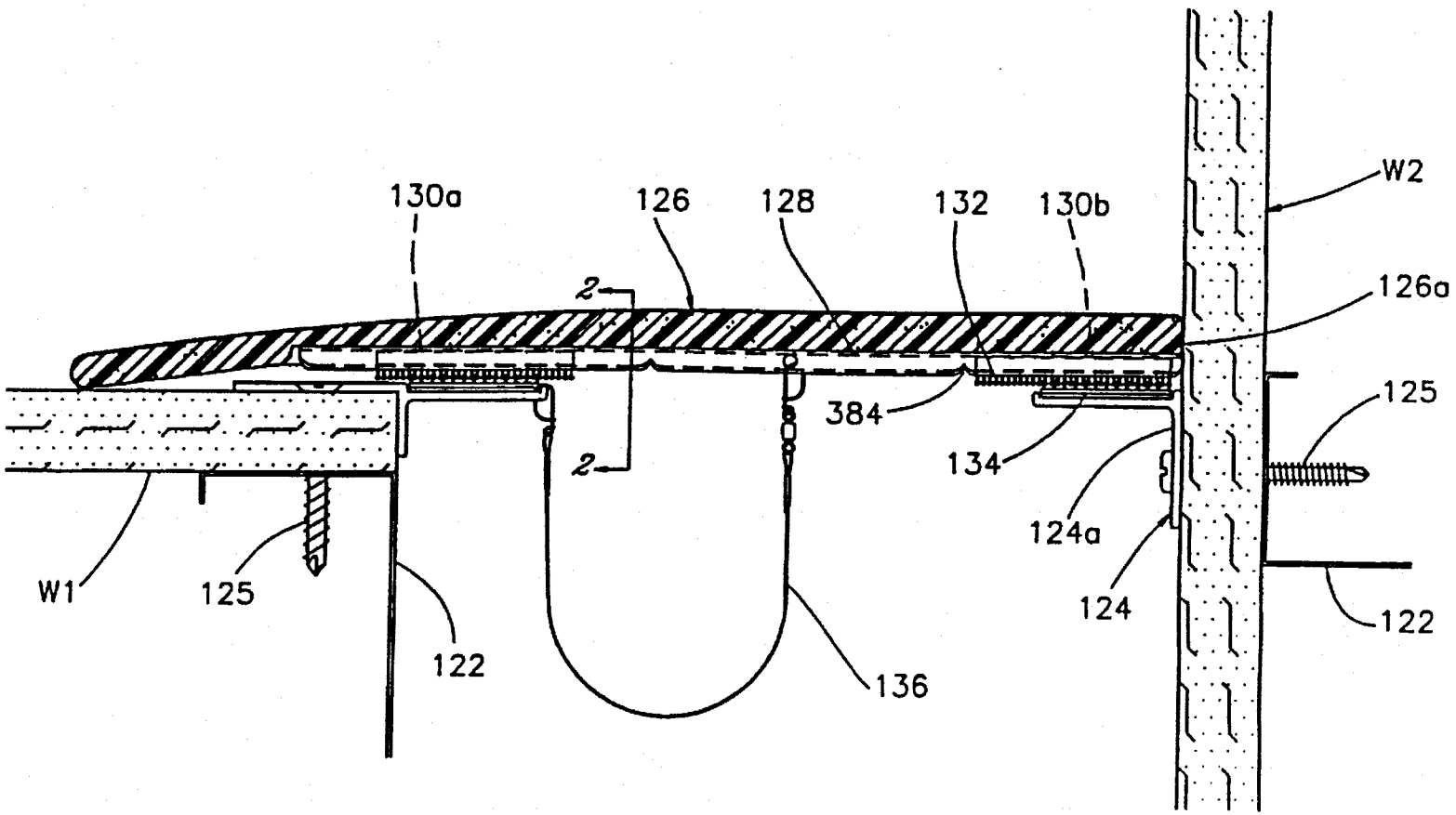
FIG. 6 is an end cross-sectional view of a second embodiment, which is structured for use at a corner.

The embodiment of FIG. 6 is in most respects the same as the embodiment of FIGS. 1 to 5. Accordingly, only the differences are described below, and the parts are given the same reference numerals as those of FIGS. 1 to 5 but increased by 100. The expansion joint cover of FIG. 6 is designed for use where the expansion joint occurs at a corner between walls W1 and W2 or where a wall meets a ceiling. In the latter case, the structure of the wall and ceiling will differ from those shown but the design of the expansion joint cover will be essentially the same. The drawing can be inverted to enable a ceiling installation to be visualized more easily. In the expansion joint cover of FIG. 6, one retainer 124 is L-shaped and is fastened by one leg 124*a* to the wall W2, and the cover 126 is reconfigured in width and shape to present an edge 126 that abuts the wall W2. The slider 130*b* is held non-movable by crimps 384 in the track 128 so that the cover remains stationary relative to the wall W2. Normal expansion and contraction of the gap is accommodated by movement of the movable slider 130*a* along the slide track 128.

Figure 7:
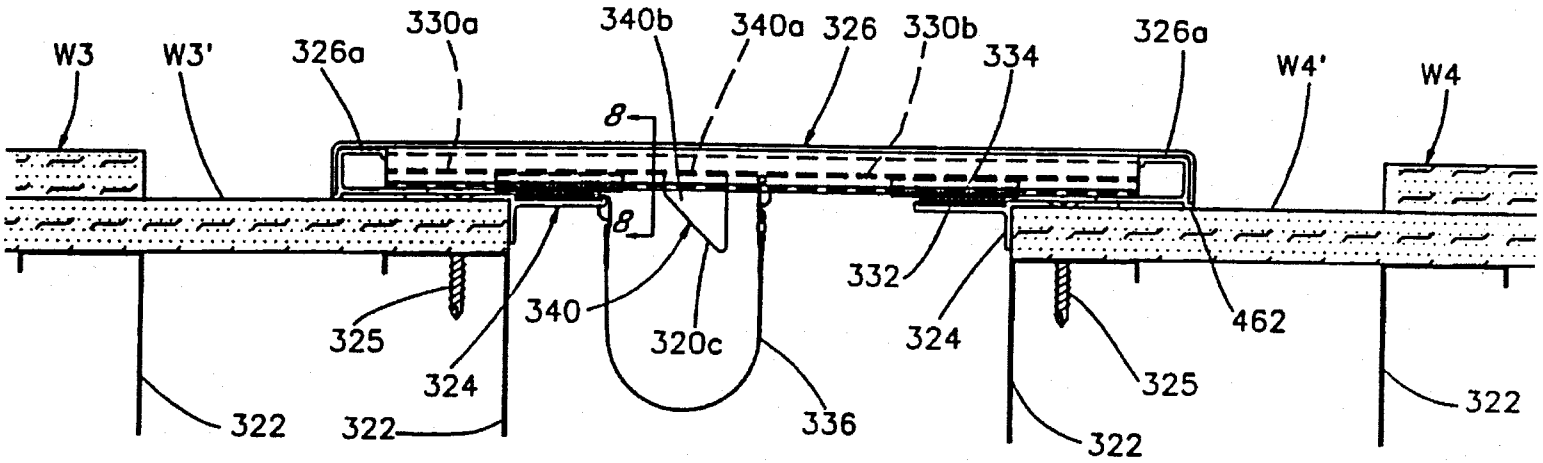
FIG. 7 is an end cross-sectional view of a third embodiment, which is a flush-mounted version.
Figure 8:
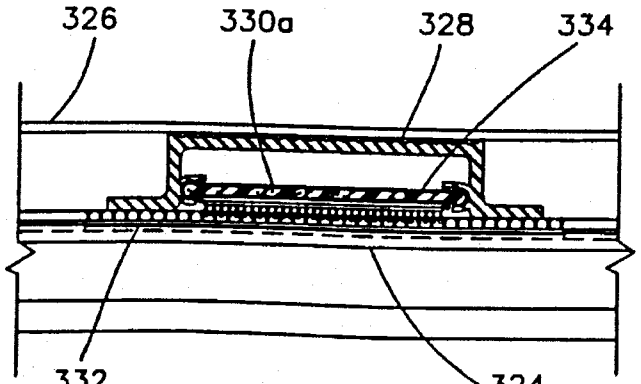
FIG. 8 is a detail side cross-sectional view of the third embodiment, taken along the lines 8—8 of FIG. 7.

The expansion joint cover shown in FIGS. 7 and 8 is configured for mounting flush with the surfaces of walls W3 and W4 or ceilings (not shown). Portions W3' and W4' of the walls on either side of the gap are recessed and provide reveal surfaces. Retainers 324 are fastened by sheet metal screws 325 to metal studs 322 and receive at intervals along their lengths one element 332 of a hook and loop fastener. The cover 326 is built up from a skeletal frame composed of a pair of longitudinal members 326a of generally J-shaped cross section along each side and slide tracks 324 located at intervals along the length of the cover and extending transversely of the cover. A facing member 326*b* of channel-shaped cross-section fits over the skeletal frame. Adhesives and/or mechanical fasteners are used to join the cover components.

The components of the cover can be of metal, such as aluminum, or of polymeric materials, such as polyvinyl chloride, which may be blended with a small amount of an acrylic polymer to increase its toughness. Other materials suitable for the cover include high density molded polymeric foam; wood; laminates of foam, such as polystyrene, with a cover sheet of metal or a rigid or semi-rigid polymer; laminates or metal or polymeric sheets with metal or polymeric honeycomb cores; and extruded aluminum or polymeric materials.

Each slide track receives a movable slider 330*a* near one end and a non-movable slider 330*b* near the other end. Each slider is attached to one of the retainers by a hook and loop fastener, one element 332 of which is secured to the retainer and the other 334 to the slider. Tethers 336 keep the cover 326 from falling to the floor when the cover is dislodged in an earthquake.

The embodiment of FIGS. 7 and 8 includes another feature, which may be incorporated into any design of expansion joint cover embodying the present invention. Each slide track 328 receives a deflector 340 having a mounting base 340*a* affixed to the slide track and a keel-like cam 340*b* having a sloping cam edge 340*c* that faces the side of the expansion gap that is movable relative to the cover. In an earthquake, a closing of the gap to a degree greater than a normal narrowing due to thermal contraction brings the retainer 324 into engagement with the cam edge 340*c* of the deflector 340 and pushes the cover away from the wall W3, thereby releasing the fasteners on the moving side of the gap. When the deflector pushes the cover away from the wall recess W3', the fasteners on the other side of the gap are also released by pivoting of the cover about the edge 462 that engages the wall recess W4'.

Figure 9:
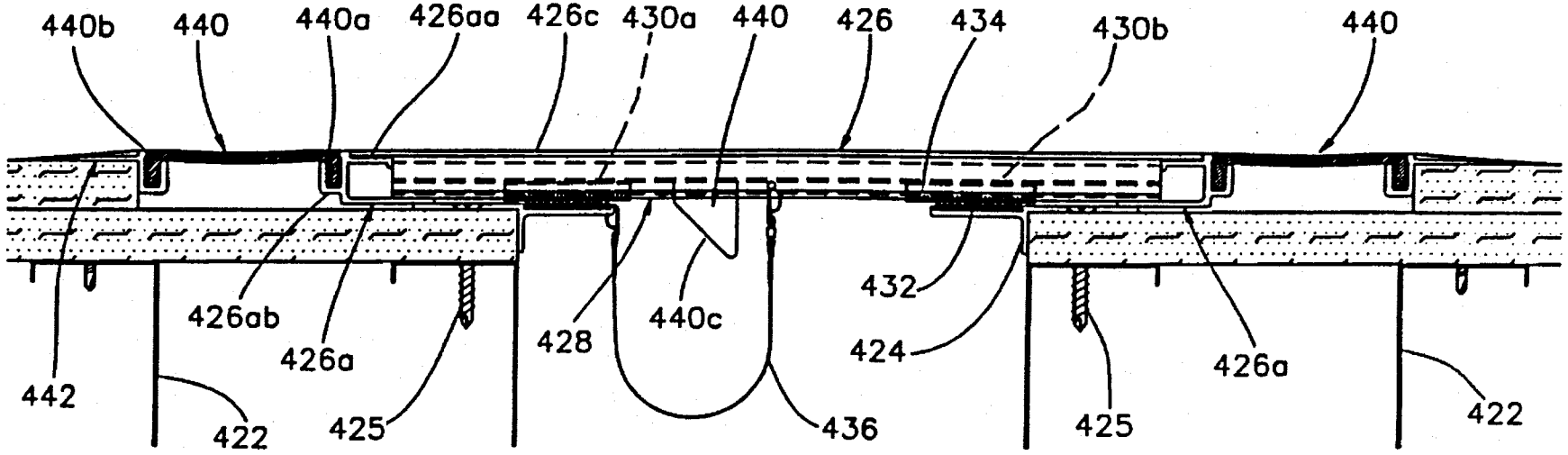
FIG. 9 is an end cross-sectional view of a fourth embodiment, which is also a flush-mounted version and includes gaskets.

The expansion joint cover of FIG. 9 is similar in most respects to the that of FIGS. 7 and 8. Therefore, the same references numerals are applied to FIG. 9 as are applied to FIGS. 7 and 8 but increased by 100. The cover 426 is built based on a skeletal frame composed of transverse slide tracks 428, a lengthwise member 426*a* along each side edge, and a facing member 426*c*, which in this case is a flat sheet that sets into a recess in a flange portion 426*aa* of the each member 426*a* and is bonded to it by an adhesive. An L-shaped flange 426*ab* on each member 426*a* forms a groove that receives one retaining leg 440*a* of a flexible gasket 440. The other retaining leg 440*b* of the gasket is received in a wall retainer 442. As mentioned above, the gaskets may be of the type described and shown in U.S. Pat. No. 5,048,249.

We claim:

1. An expansion joint cover installation comprising first and second building members having an expansion gap between them, a first retainer attached to the first building member adjacent the expansion gap, a second retainer attached to the second building member adjacent the expansion gap, an elongated cover having a longitudinal axis, an internal face, an external face and side edges, the cover spanning the expansion gap and overlying at least a portion of the first retainer and at least a portion of the second retainer, at least two first releasable fasteners joining the cover to the first retainer, the first fasteners being spaced apart lengthwise of the cover, at least one slide track attached to the internal face of the cover and extending perpendicular to the longitudinal axis and being positioned to overlie the second retainer, a movable slider received in the slide track for movement along the track, and a second releasable fastener joining the slider to the second retainer.

2. An expansion joint cover installation according to claim 1 wherein the first and second releasable fasteners are fasteners selected from the group consisting of hook and loop fasteners, magnets, and gravity clips.

3. An expansion joint cover installation according to claim 1 and further comprising tethering means for connecting the cover to one of the first and second building members such as to retain the cover proximate to the building member in the event of release of the fasteners.

4. An expansion joint cover installation according to claim 3 wherein the tethering means is a flexible cable.

5. An expansion joint cover installation according to claim 1 wherein the slide track is recessed into the internal face of the cover and one edge of the cover is in sliding relation proximate to a surface of the second building member.

6. An expansion joint cover installation according to claim 5 wherein said surface of the building member is a surface of a recessed portion of the second building member, the recessed portion having an edge spaced apart from the expansion gap.

7. An expansion joint cover installation according to claim 1 wherein the slide track extends across the cover such that a portion of the slide track overlies the first retainer, a second slide member is received in the slide track in said portion, and one of the first releasable fasteners is connected between the second slide member and the first retainer.

8. An expansion joint cover installation according to claim 1 wherein edge portions of the internal face adjacent the side edges of the cover overlie substantially coplanar surfaces of the first and second building members in closely adjacent sliding relation.

9. An expansion joint cover installation according to claim 8 wherein the slide track extends across the cover such that a portion overlies the first retainer, a second slide member is received in the slide track in said portion, and one of the first releasable fasteners is connected between the second slide member and the first retainer.

10. An expansion joint cover installation according to claim 9 wherein the slide track is recessed into the internal face of the cover, and each edge of the cover is in sliding relation proximate to a surface of a building member on a corresponding side of the expansion gap.

11. An expansion joint cover installation according to claim 1 wherein the cover has a substantially uniform profile in transverse cross-section along its length and is substantially thicker at the longitudinal center than adjacent the edges.

12. An expansion joint cover installation according to claim 11 wherein the external face of the cover is convexly curved laterally.

13. An expansion joint cover installation according to claim 12 wherein the internal face of the cover is substantially planar.

14. An expansion joint cover installation according to claim 1 wherein the cover is made of a composite material that includes a fiber filler and a resin binder.

15. An expansion joint cover installation according to claim 13 wherein the cover is made of a composite material that includes a fiber filler and a resin binder.

16. An expansion joint cover installation according to claim 14 wherein the fiber filler is fiberglass.

17. An expansion joint cover installation according to claim 14 wherein the external face of the cover has a covering of a sheet material that is adapted to receive paint or wallpaper.

18. An expansion joint cover installation according to claim 14 wherein the covering is paper.

19. An expansion joint cover installation according to claim 1 wherein the cover has a substantially uniform profile in transverse cross-section along its length, the external face of the cover is convexly curved laterally, the internal face of the cover is substantially planar, and the cover is made of a composite material that includes a fiber filler and a resin binder.

20. An expansion joint cover installation according to claim 19 wherein the building members have substantially coplanar surfaces adjacent the expansion gap and the side edges of the cover overlie and either slidably engage or are closely adjacent the coplanar surfaces.

21. An expansion joint cover installation according to claim 20 wherein the external face of the cover has a covering of a sheet material that is adapted to receive paint or wallpaper.

22. An expansion joint cover installation according to claim 1 wherein the cover is received in recessed portions of building members on either side of the expansion gap and the outer surface of the cover is substantially flush with coplanar wall portions of the building members adjacent the recessed portions.

23. An expansion joint cover installation according to claim 22, and further comprising deflector means coacting between the cover and at least one of the building members for effecting detachment of the fasteners upon narrowing of the expansion gap to a predetermined extent.

24. An expansion joint cover installation according to claim 22 and further comprising a flexible gasket connected between each edge of the cover and an edge of a surface adjacent the recessed portion of the building member.

25. An expansion joint cover installation according to claim 1, and further comprising deflector means coacting between the cover and at least one of the building members for effecting detachment of the fasteners upon narrowing of the expansion gap to a predetermined extent.

26. An expansion joint cover installation for concealing an expansion gap between building walls and ceilings, comprising a first building member on one side of the expansion gap, a second building member on the other side of the expansion gap, a first retainer attached to the first building member, a second retainer attached to the second building member, an elongated cover having a longitudinal axis, an internal face, an external face and side edges, the cover having a width transverse to the longitudinal axis such as to span the expansion gap and overlie at least portions of the first and second retainers, and releasable fastener means connecting the cover to the retainers, the releasable fastener means including at least two slide tracks attached in longitudinally spaced-apart relation to the internal face of the cover, each slide track being perpendicular to the longitudinal axis, a movable slider received in each slide track for sliding movement along the track, and a releasable fastener joining each slider to the second retainer.

27. An expansion joint cover installation according to claim 26 and further comprising at least one flexible cable tether connecting the cover to one of the building members such as to retain the cover proximate to the building members in the event of release of the fasteners.

28. An expansion joint cover installation according to claim 26 wherein each slide track is recessed into the internal face of the cover, and a side edge of the cover member overlying the second building retainer is in sliding proximate relation to a surface of the second building member.

29. An expansion joint cover installation according to claim 28 wherein the surface of the second building member is a surface of a recessed portion of a building member, the recessed portion having an edge spaced apart from the expansion gap.

30. An expansion joint cover installation according to claim 26 wherein each slide track extends across the cover such that a portion of each slide track overlies the first building member, a second slide member is received in each slide track in said portion, and a releasable fastener is connected between the second slide member and the first retainer.

31. An expansion joint cover installation according to claim 26 wherein edge portions of the internal face adjacent the side edges of the cover overlie in proximate sliding relation substantially coplanar wall surfaces of the building members on either side of the gap.

32. An expansion joint cover installation according to claim 26 wherein the cover is made of a composite material that includes a fiber filler and a resin binder.

33. An expansion joint cover installation according to claim 26 wherein the cover has a substantially uniform profile in transverse cross-section along its length and is substantially thicker at the longitudinal center than adjacent the edges.

34. An expansion joint cover installation according to claim 33 wherein the external face of the cover is convexly curved laterally.

35. An expansion joint cover installation according to claim 34 wherein the external face of the cover has a covering of a sheet material that is adapted to receive paint or wallpaper.

36. An expansion joint cover installation according to claim 26 wherein portions of the cover adjacent the edges are received in recessed portions of building members on either side of the expansion gap, and the edges of the cover overlie the recessed portions in slidable relation.

37. An expansion joint cover installation according to claim 26 and further comprising deflector means coacting between the cover and at least one of the building members for effecting release of the releasable fasteners upon narrowing of the expansion gap to a predetermined extent.

38. An expansion joint cover installation according to claim 37 and further comprising a flexible gasket connected between each edge of the cover and an edge of a surface adjacent the recessed portion of the building member.

39. An expansion joint cover installation according to claim 37 wherein the cover member is of substantially uniform thickness throughout and its external surface is substantially flush with said edge of a surface adjacent the recessed portion.

40. A cover unit for an expansion joint cover installation and adapted to be attached to building members on opposite sides of an expansion gap, comprising a elongated cover having a longitudinal axis, an internal face, an external face and side edges, the cover being adapted to span and cover the expansion gap, one element of a releasable fastener affixed to the internal face of the cover at each of a plurality of longitudinally spaced-apart locations adjacent one side edge of the cover, a plurality of slide tracks attached to the internal face of the cover adjacent the other side edge and extending perpendicular to the longitudinal axis, a movable slide member received in each slide track for movement along the track, and one element of a releasable fastener affixed to an internal face of each slide member.

41. A cover unit according to claim 40 wherein each slide track is recessed into the internal face of the cover.

42. A cover unit according to claim 40 wherein the cover is made of a composite material that includes a fiber filler and a resin binder.

43. A cover unit according to claim 42 wherein the external face of the cover has a covering of a sheet material that is adapted to receive paint or wallpaper.

44. A cover unit according to claim 40 wherein the cover has a substantially uniform profile in transverse cross-section along its length and is substantially thicker at the longitudinal center than adjacent the edges.

45. A cover unit according to claim 44 wherein the external face of the cover is convexly curved laterally.

* * * * *